US010134333B2

(12) United States Patent
Park

(10) Patent No.: US 10,134,333 B2
(45) Date of Patent: Nov. 20, 2018

(54) DISPLAY DEVICE AND METHOD OF DRIVING THE SAME

(71) Applicant: SAMSUNG DISPLAY CO., LTD., Yongin-si, Gyeonggi-do (KR)

(72) Inventor: Su-Hyeong Park, Gyeongju-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 153 days.

(21) Appl. No.: 15/140,513

(22) Filed: Apr. 28, 2016

(65) Prior Publication Data

US 2017/0039955 A1 Feb. 9, 2017

(30) Foreign Application Priority Data

Aug. 4, 2015 (KR) ..... 10-2015-0110011

(51) Int. Cl.
*G09G 3/32* (2016.01)
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/0291* (2013.01); *G09G 2320/029* (2013.01); *G09G 2320/0223* (2013.01); *G09G 2330/021* (2013.01); *G09G 2330/028* (2013.01)

(58) Field of Classification Search
CPC ..... G09G 3/3233; G09G 2300/0819; G09G 2300/0842; G09G 2300/0861; G09G 5/00; G09G 3/3291; G09G 2330/021; G09G 2310/0291; G09G 2320/0223; G09G 2320/029; G09G 2330/028; G02F 1/13318
See application file for complete search history.

(56) References Cited

U.S. PATENT DOCUMENTS

2005/0218302 A1* 10/2005 Shin ..... G02F 1/13318 250/214 R
2012/0146979 A1* 6/2012 Kim ..... G09G 3/3233 345/211
2012/0235973 A1* 9/2012 Yoo ..... G09G 3/3233 345/211
2013/0300726 A1* 11/2013 Son ..... G09G 5/00 345/212
2013/0342114 A1* 12/2013 Lee ..... G09G 3/3291 315/169.3
2015/0187268 A1* 7/2015 Tani ..... G09G 3/3233 345/77

(Continued)

FOREIGN PATENT DOCUMENTS

KR 10-0894606 B1 4/2009
KR 10-2011-0123983 A 11/2011
KR 10-2012-0114989 A 10/2012

(Continued)

*Primary Examiner* — Richard Hong
(74) *Attorney, Agent, or Firm* — Lee & Morse P.C.

(57) ABSTRACT

A display device includes a display panel, a controller, a power supplier, and an initialization voltage generator. The controller generates a power control signal based on an input image. The power supplier generates a variable driving voltage that is changed based on the power control signal. The initialization voltage generator changes an initialization voltage to initialize the pixels based on the variable driving voltage.

18 Claims, 10 Drawing Sheets

(56) References Cited

U.S. PATENT DOCUMENTS

2015/0294626 A1* 10/2015 Bi ..... G09G 3/3233
345/211

FOREIGN PATENT DOCUMENTS

| | | | |
|---|---|---|---|
| KR | 10-2013-0018493 | A | 2/2013 |
| KR | 10-2014-0028860 | A | 3/2014 |
| KR | 10-2016-0076179 | A | 6/2016 |

* cited by examiner

DISPLAY DEVICE AND METHOD OF DRIVING THE SAME

CROSS-REFERENCE TO RELATED APPLICATION

Korean Patent Application No. 10-2015-0110011, filed on Aug. 4, 2015, and entitled: "Display Device and Method of Driving the Same," is incorporated by reference herein in its entirety.

BACKGROUND

1. Field

One or more embodiments described herein relate to a display device and a method of driving a display device.

2. Description of the Related Art

An organic light emitting display may prevent a data signal from changing using a parasitic capacitor of an organic light emitting diode. This may be accomplished by initializing a pixel (or, discharging the parasitic capacitor of the organic light emitting diode) using a certain initialization voltage before the data signal is applied.

One technique that reduces power consumption of an organic light emitting display device involves analyzing an input image and changing a low power voltage ELVSS based on a result of the analysis. However, a discharging characteristic of the pixel (e.g., the parasitic capacitor of the pixel) may change, because a voltage difference between the low power voltage ELVSS and the initialization voltage (e.g., a voltage across the parasitic capacitor) may change as the low power voltage ELVSS changes. For example, when the pixel is over-discharged according to a change in the voltage difference, a charging time of the pixel may increase (e.g., an emission response may be delayed). An afterimage phenomenon may occur as a result.

SUMMARY

In accordance with one or more embodiments, a display device includes a display panel including pixels; a controller to generate a power control signal based on an input image; a power supplier to generate a variable driving voltage that is changed based on the power control signal; and an initialization voltage generator to change an initialization voltage to initialize the pixels based on the variable driving voltage. The initialization voltage may have a substantially constant voltage difference from the variable driving voltage.

The initialization voltage generator may include a voltage generator to output a setting voltage based on a first reference voltage; and a voltage adder to generate the initialization voltage based on the variable driving voltage and the setting voltage. The voltage generator may include a first resistor; a first amplifier including a first input terminal to receive the first reference voltage through the first resistor, a second input terminal electrically connected to a reference voltage, and an output terminal to output the setting voltage; and a second resistor electrically connected between the first input terminal and the output terminal.

The voltage adder may include a third resistor; a second amplifier including a first input terminal to receive the setting voltage through the third resistor, a second input terminal to receive the variable driving voltage, and an output terminal to output the initialization voltage; and a fourth resistor electrically connected between the first input terminal and the output terminal. The initialization voltage generator may include a first selector to output one of a reference initialization voltage or the initialization voltage.

The display device may include a voltage sensor to measure a local driving voltage of the display panel, wherein the initialization voltage generator includes a second selector to provide the voltage adder with one of the local driving voltage or the variable driving voltage. The second selector may include a multiplexer to select one of the local driving voltage and the variable driving voltage; and a buffer amplifier to transfer an output of the multiplexer to the voltage adder.

The voltage sensor may measure a plurality of local driving voltages at a plurality of measuring points of the display panel, respectively, and to sequentially output the local voltages. The initialization voltage generator may sequentially generate a plurality of initialization voltages based on the local driving voltages.

The display device may include a voltage sensor to measure a local driving voltage of the display panel, wherein the voltage generator is to generate the setting voltage based on the local driving voltage, the variable driving voltage, and the first reference voltage. The voltage generator may include a subtractor to calculate a voltage difference between the variable driving voltage and the local driving voltage and to generate a second reference voltage based on the voltage difference; and an adder to generate the setting voltage by adding the first reference voltage and the second reference voltage.

In accordance with one or more other embodiments, a display device includes a display panel including pixels; a timing controller to generate a power control signal based on an input image; a power supplier to generate a variable driving voltage that is changed based on the power control signal; a voltage sensor to measure a local driving voltage provided to the display panel according to the variable driving voltage; and an initialization voltage generator to change an initialization voltage to initialize the pixels based on the variable driving voltage. The initialization voltage may have a constant voltage difference from the variable driving voltage.

The initialization voltage generator may include a voltage generator to output a setting voltage based on a first reference voltage; a second selector to select one of the variable driving voltage or the local driving voltage; a voltage adder to generate the initialization voltage based on the setting voltage and one of the variable driving voltage or the local driving voltage; and a first selector to output one of a reference initialization voltage or the initialization voltage. The second selector may include a multiplexer to select one of the local driving voltage or the variable driving voltage; and a buffer amplifier to transfer an output of the multiplexer to the voltage adder. The voltage sensor may measure a plurality of local driving voltages at a plurality of measuring points, respectively, and sequentially output the local voltages. The initialization voltage generator may sequentially generate a plurality of initialization voltages based on the local driving voltages.

In accordance with one or more embodiments, a method for driving a display device includes generating a power control signal to control a variable driving voltage of the display device based on an input image; generating the variable driving voltage based on the power control signal; and changing an initialization voltage to initialize a plurality of pixels based on the variable driving voltage. Changing the initialization voltage may include measuring a local driving voltage provided to the display panel according to the variable driving voltage; and changing the initialization voltage based on the local driving voltage.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
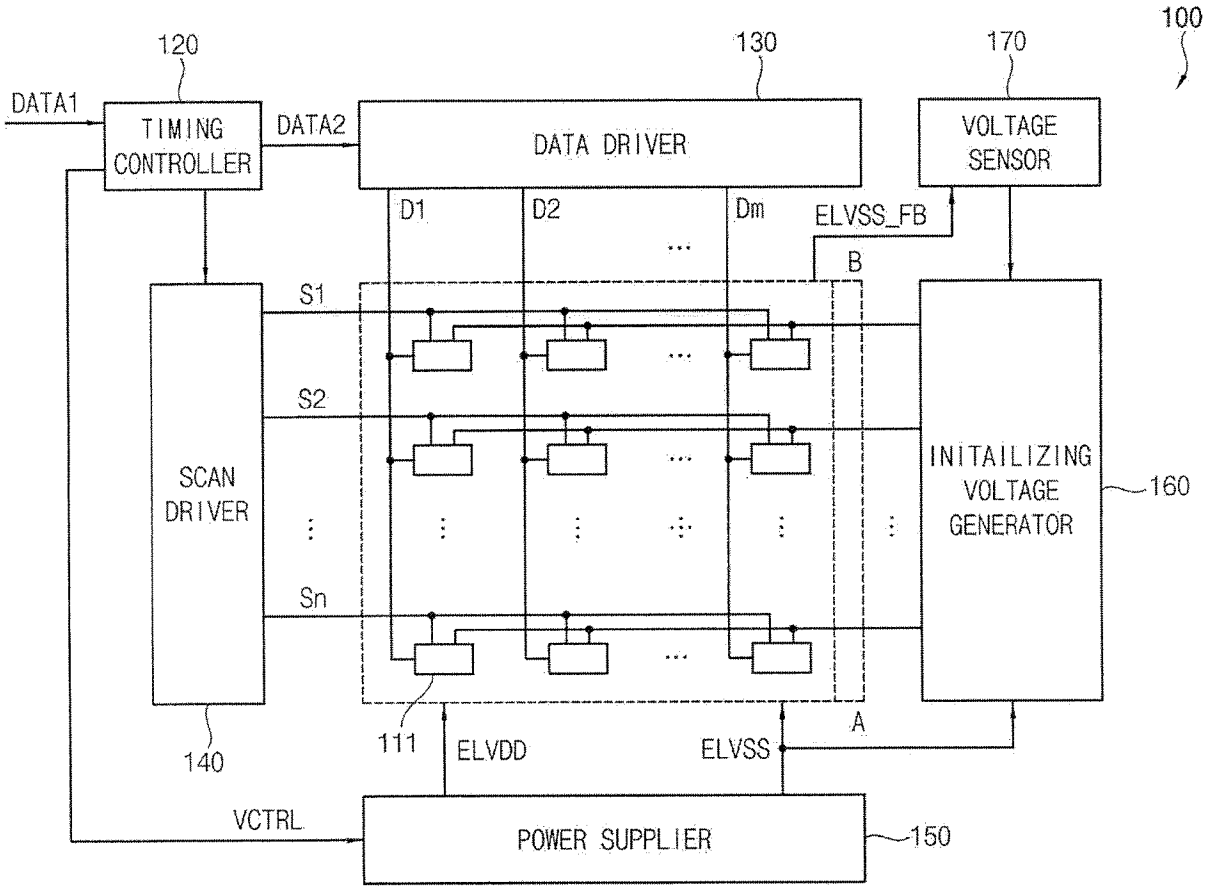
FIG. 1 illustrates an embodiment of a display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of a display device 100 which includes a display panel 110, a timing controller 120, a data driver 130, a scan driver 140, a power supplier 150, and an initialization voltage generator 160. In some example embodiments, the display device 100 may further include a voltage sensor 170. The display device 100 may display an image based on image data provided from a source. The display device 100 may be, for example, an organic light emitting display device.

The display panel 110 may include scan lines S1 through Sn, data lines D1 through Dm, and pixels 111, where each of m and n is an integer greater than or equal to 2. The pixels 111 may be respectively disposed at intersections of the scan lines S1 through Sn and the data lines D1 through Dm. Each of the pixels 111 may store a data signal in response to a scan signal and may emit light based on a stored data signal.

The timing controller 120 may control the data driver 130, the scan driver 140, and the power supplier 150. The timing controller 120 may generate a scan driving control signal, a data driving control signal, and a power control signal VCTRL to control the data driver 130, scan driver 140, and power supplier 150.

In some example embodiments, the timing controller 120 may generate the power control signal VCTRL to control a variable driving voltage of the display panel 110 based on an input image. The input image may be provided, for example, from an external source. The variable driving voltage may include driving voltages to drive the display panel 110. For example, the variable driving voltage may include a first power voltage ELVDD and a second power voltage ELVSS. The first power voltage ELVDD may have a higher voltage level than the second power voltage ELVSS.

The timing controller 120 may calculate an on-pixel ratio (OPR) of the input image DATA1 (e.g., an image of a certain frame) and may generate the power control signal VCTRL to change the second power voltage ELVSS based on the on-pixel ratio. For example, when the on-pixel ratio of the input image DATA1 is low (e.g., below a predetermined value), the timing controller 120 may generate the power control signal to generate a variable power voltage ELVSS_var having a voltage level lower than a voltage level of the second power voltage ELVSS predetermined.

The data driver 130 may generate the data signal based on an image data (e.g., a second data DATA2). The data driver 130 may provide the data signal to the display panel 110 in response to the data driving control signal. For example, the data driver 130 may provide the data signal to the pixels 111 through the data lines D1 through Dm. The data driving control signal may be sent from the timing controller 160 to data driver 130.

The scan driver 140 may generate the scan signal based on the scan driving control signal. The scan driving control signal may include a start pulse and clock signals. The scan driver 140 may include a shift register sequentially generating the scan signal corresponding to the start pulse and the clock signals.

In some example embodiments, the display device may include an emission driver to generate an emission control signal to be provided to the pixel through emission control lines.

The power supplier 150 may generate the variable driving voltage (e.g., the first power voltage ELVDD and the second power voltage ELVSS) based on the power control signal. The first power voltage ELVDD may have a fixed voltage level. The second power voltage ELVSS may have a variable voltage level changed based on the power control signal. The power supplier 150 may include a direct voltage to direct voltage (DC-DC) convertor.

The initialization voltage generator 160 may generate the initialization voltage to initialize the pixels 111. In some example embodiments, the initialization voltage generator 160 may change the initialization voltage based on the variable driving voltage. For example, the initialization voltage generator 160 may change the initialization voltage to maintain (or otherwise control) a certain constant voltage difference between the initialization voltage and the second power voltage ELVSS.

In some example embodiments, the initialization voltage generator 160 may generate a constant initialization voltage having a fixed voltage level and a variable initialization voltage having a variable voltage level. The initialization voltage generator 160 may provide the display panel 110 with one of the constant initialization voltage and the variable initialization voltage.

In some example embodiments, the initialization voltage generator 160 may generate the initialization voltage based on a local driving voltage of the display panel 110 measured by the voltage sensor 170. For example, the initialization voltage generator 160 may change the initialization voltage to maintain (or otherwise control) a certain constant voltage difference between the initialization voltage and the local driving voltage. The local driving voltage may include a resistance drop (or a current-resistance drop, an ohmic drop, or IR drop) of the driving voltage. For example, the local driving voltage may be the second power voltage ELVSS that is dropped.

The voltage sensor 170 may measure (or detect or sense) the local driving voltage of the display panel 110. For example, the second power voltage ELVSS supplied to the display panel 110 may be dropped by a resistance of a power supplying line. The voltage sensor 170 may measure the second power voltage ELVSS actually provided to the pixels 111.

In some example embodiments, the voltage sensor 170 may measure a plurality of local driving voltages and may provide the local driving voltages to the initialization generator 160. For example, the voltage sensor 170 may measure local driving voltages for each of a plurality of pixel rows and may sequentially provide the local driving voltages to the initialization generator 160. The initialization voltage generator 160 may sequentially generate a plurality of initialization voltages according to the local driving voltages. For example, the initialization voltage generator 160 may generate a first initialization voltage based on a first local driving voltage of a first pixel row and a second initialization voltage based on a second local driving voltage of a second pixel row, and may output the first initialization voltage and the second initialization voltage sequentially.

Thus, in one embodiment, the display device 100 may change the initialization voltage to have a constant voltage difference from the variable driving voltage. Therefore, the display device 100 may maintain a discharging characteristic of the pixels 111 based on the constant voltage difference and may improve an emission response of the pixels 111.

Figure 2:
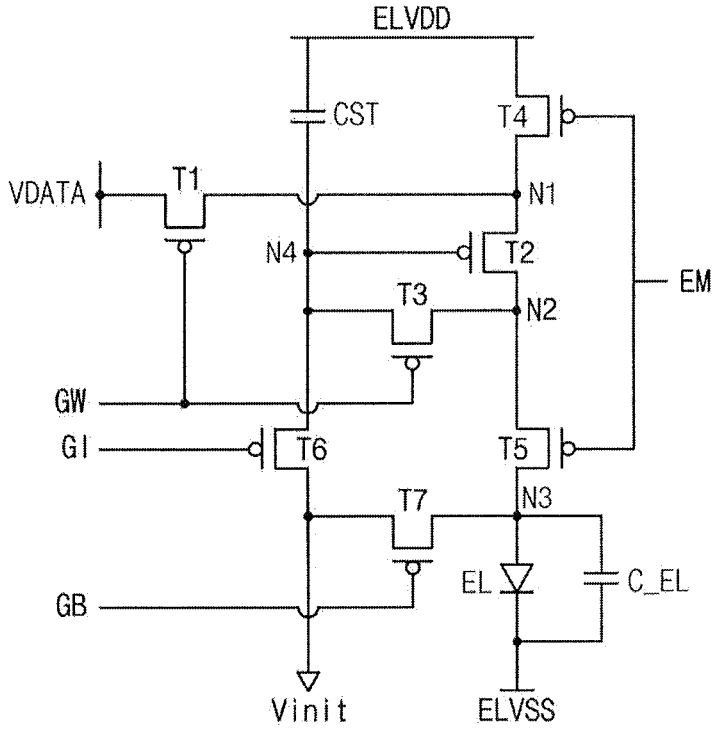
FIG. 2 illustrates an embodiment of a pixel.

FIG. 2 illustrates an embodiment of a pixel 111, which, for example, may be representative of the pixels in the display device 100 of FIG. 1. Referring to FIG. 2, the pixel 111 includes a first transistor T1, a second transistor T2, a third transistor T3, a storage capacitor Cst, a fourth transistor T4, a fifth transistor T5, a sixth transistor T6, a seventh transistor T7, and an emission element EL.

The first transistor T1 may be electrically connected between a data line and a first node N1 and may be turned on in response to a scan signal GW. The second transistor T2 may be electrically connected between the first node N1 and a second node N2 and may be turned on in response to a voltage at a fourth node N4. The third transistor T3 may be electrically connected between the second node N2 and the fourth node N4 and may be turned on in response to the scan signal GW.

The storage capacitor Cst may be electrically connected between the first power voltage ELVDD and the fourth node N4. The storage capacitor Cst may be charged with a voltage corresponding to a data signal provided through the data line when the first through third transistors T1 through T3 are turned on in response to the scan signal GW.

The fourth transistor T4 may be electrically connected between the first power voltage ELVDD and the first node N1, and the fifth transistor T5 may be electrically connected between the second node N2 and the emission element EL. The fourth transistor T4 and the fifth transistor T5 may be turned on in response to an emission control signal EM and may provide the emission element EL with a driving current corresponding to a charged voltage at the storage capacitor Cst, with the second transistor T2.

The emission element EL may emit light with a luminance corresponding to the driving current. The emission element EL may include a parasitic capacitor C_EL. The parasitic capacitor C_EL may be charged with a voltage supplied to the emission element EL during the emission element EL emits light based on the driving current.

The sixth transistor T6 may be electrically connected between the fourth node N4 and an initialization voltage Vinit and may be turned on in response to a first initialization signal GI. When the sixth transistor T6 is turned on, the charged voltage at the storage capacitor Cst may be initialized to have the initialization voltage Vinit. For example, storage capacitor Cst may be discharged based on initialization voltage Vinit.

The seventh transistor T7 may be electrically connected between the third node N3 and the initialization voltage Vinit and may be turned on in response to a second initialization voltage GB. The second initialization voltage GB may be the same as the first initialization voltage GI. When the seventh transistor T7 is turned on, the charged voltage at the parasitic capacitor C_EL may be initialized based on the initialization voltage Vinit. That is, the parasitic capacitor C_EL may be discharged based on the initialization voltage Vinit.

When the second power voltage ELVSS is variable and the initialization voltage Vinit is fixed, a discharging characteristic of the parasitic capacitor C_EL may be varied corresponding the a change of the second power voltage ELVSS. For example, the parasitic capacitor C_EL may be over-discharged corresponding to a level of the second power voltage ELVSS. The parasitic capacitor C_EL may have a charging time greater than a general charging time. Therefore, an afterimage may occur on the display panel 110.

The display device 100 according to one embodiment may change the initialization voltage Vinit to maintain (or keep) a voltage difference between the second power voltage ELVSS and the initialization voltage Vinit constant. Therefore, the voltage difference applied to the parasitic capacitor C_EL may be constant. This, the discharging characteristic of the parasitic capacitor C_EL may be maintained constant according to the voltage difference applied to the parasitic capacitor C_EL that is constant. Therefore, the display device 100 may reduce or prevent an afterimage from occurring due to a variation (or change) of the discharging characteristic of the parasitic capacitor C_EL.

Figure 3:
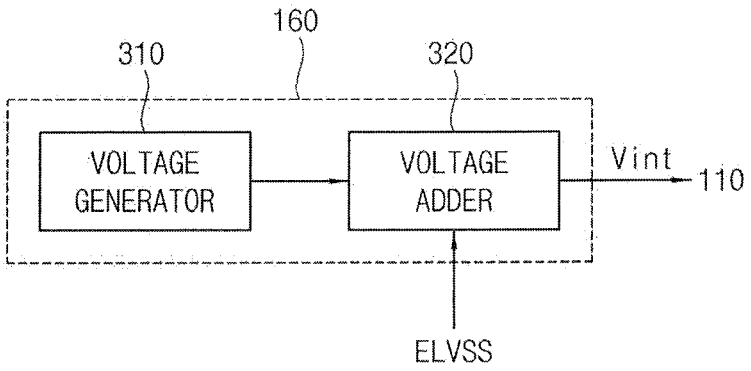
FIG. 3 illustrates an embodiment of an initialization voltage generator.
Figure 4:
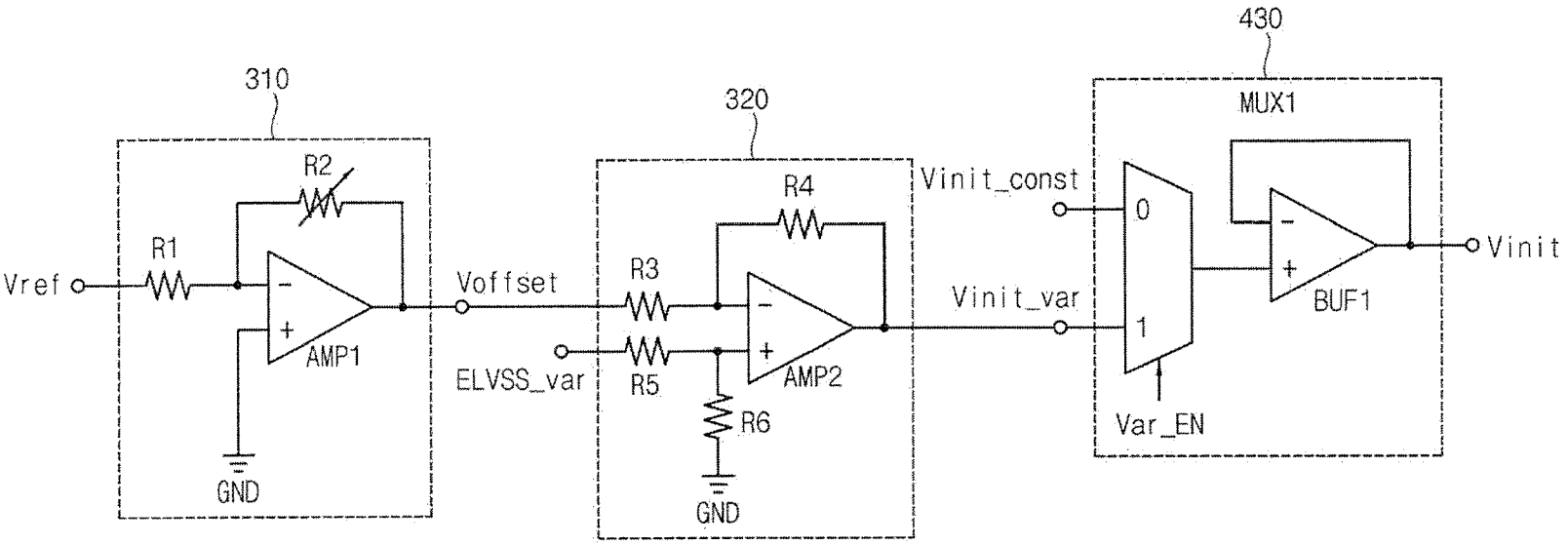
FIG. 4 illustrates an example of a circuit of the initialization voltage generator.

FIG. 3 illustrates an embodiment of an initialization voltage generator, which, for example, may be included in the display device 100 of FIG. 1. FIG. 4 is a circuit diagram illustrating an example of the initialization voltage generator of FIG. 3.

Referring to FIGS. 3 and 4, the initialization voltage generator 160 includes a voltage generator 310 and a voltage adder 320. The voltage generator 310 may generate a setting voltage Voffset. The setting voltage Voffset may have a voltage level that is, for example, the same as a voltage difference between the variable driving voltage and the initialization voltage.

As illustrated in FIG. 4, the voltage generator 310 may include a first resistor R1, a first amplifier AMP1, and a second resistor R2. The first amplifier AMP1 may include a first input terminal that receives a reference voltage Vref (or, a first reference voltage) through the first resistor R1, a second input terminal electrically connected to a ground voltage GND, and an output terminal that outputs the setting voltage Voffset. The second resistor R2 may be electrically connected between the first input terminal of the first amplifier AMP1 and the output terminal of the first amplifier AMP1. The reference voltage Vref may be predetermined and may have a fixed voltage level. For example, the reference voltage Vref may be a power voltage (e.g., DC 3.7 volts (V)) supplied to the display device 100.

In some example embodiments, the setting voltage Voffset may be represented by Equation 1.

$$Voffset=-(R2/R1)*Vref \quad (1)$$

In some example embodiments, the voltage generator 310 may change the setting voltage Voffset by changing the second resistor R2. For example, the voltage generator 310 may increase the setting voltage Voffset by increasing the second resistor R2 (or a resistance of the second resistor R2).

The voltage adder 320 may add up (or sum) the setting voltage Voffset and the variable driving voltage ELVSS_var. For example, the voltage adder 320 may generate a variable initialization voltage Vinit_var by setting the voltage Voffset to be greater than the variable driving voltage ELVSS_var.

As illustrated in FIG. 4, the voltage adder 320 may include a third resistor R3, a second amplifier AMP2, and a fourth resistor R4. The second amplifier AMP2 may include a first input terminal that receives the setting voltage Voffset through the third resistor, a second input terminal that receives the variable driving voltage ELVSS_var, and an output terminal that outputs the initialization voltage Vinit (or variable initialization voltage Vinit_var). The fourth resistor R4 may be electrically connected between the first input terminal of the second amplifier AMP2 and the output terminal of the second amplifier AMP2. A first voltage supplied to the second input terminal of the second amplifier AMP2 may be a half of the variable driving voltage ELVSS_var.

As illustrated in FIG. 4, the first voltage may have a voltage level distributed by a fifth resistor R5 and a sixth resistor R6 that are electrically connected in series between the variable driving voltage ELVSS_var and the ground voltage GND. When a resistance of the fifth resistor R5 is the same as a resistance of the sixth resistor R6, the first voltage may be ELVSS_var/2.

The variable initialization voltage Vinit_var may be represented by Equation 2.

$$\begin{aligned} \text{Vinit_var} &= (0.5*\text{ELVSS_var}) + [(0.5*\text{ELVSS_var}) - Voffset] \quad (2) \\ &= \text{ELVSS_var} + Voffset \\ &\text{(or, } = \text{ELVSS_var} + ((R2/R1)*Vref) \end{aligned}$$

That is, the variable initialization voltage Vinit_var may be greater the variable driving voltage ELVSS_var by the setting voltage Voffset.

In some example embodiments, the initialization voltage generator 160 may include a first selector 430 to select one of a reference initialization voltage Vinit_const that is preset (or predetermined) or the variable initialization voltage Vinit_var. The first selector 430 for output. The reference initialization voltage Vinit_const may be used in the display device 100 when the initialization voltage Vinit is not changed. The reference initialization voltage Vinit_const may have a constant voltage level. The initialization voltage generator 160 may selectively output the variable initialization voltage and an initialization voltage using the first selector 430. The initialization voltage may be a predetermined value.

As illustrated in FIG. 4, the first selector 430 may include a first multiplexer MUX1 and a first buffer BUF1. The first multiplexer MUX1 may receive the reference initialization voltage Vinit_const and the variable initialization voltage Vinit_var and output one of the reference initialization voltage Vinit_const or the variable initialization voltage Vinit_var in response to a selection control signal Var_EN. The selection control signal Var_EN may be provided from the timing control 120. The first buffer BUF1 may be implemented as a buffer amplifier and may output the initialization voltage Vinit having a voltage level that is the same as a voltage level of a selected voltage (e.g., one of the reference initialization voltage Vinit_const or the variable initialization voltage Vinit_var).

As described above, the initialization voltage generator 160 may maintain (or keep) a voltage difference between the variable driving voltage ELVSS_var and the variable initialization voltage Vinit_var constant (e.g., voltage difference=setting voltage Voffset). In addition, the initialization voltage generator 160 may selectively (or alternatively) output the variable initialization voltage Vinit_var and the reference initialization voltage Vinit_const.

Figure 5:
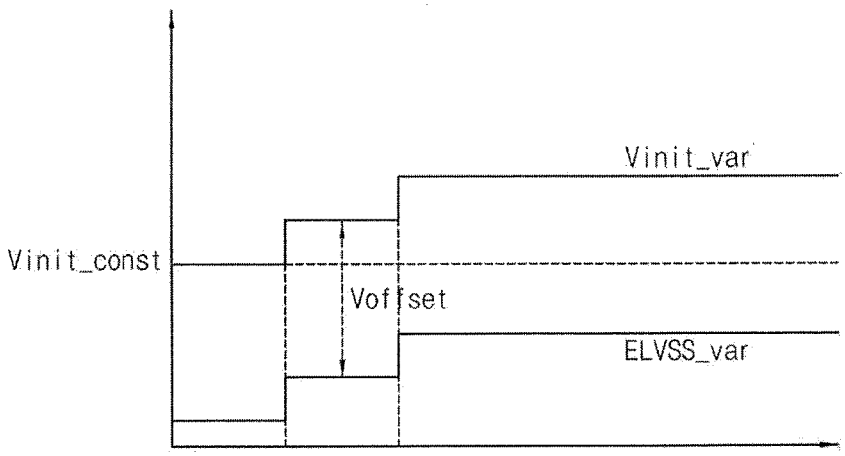
FIG. 5 illustrates an example of an initialization voltage.

FIG. 5 is a waveform diagram illustrating an example of an initialization voltage generated by the initialization voltage generator of FIG. 3. Referring to FIG. 5, the variable driving voltage ELVSS_var may be varied (or changed). As described with reference to FIG. 1, the variable driving voltage ELVSS_var may be changed according to an analysis result of an input image (e.g., an on-pixel ratio). In one embodiment, the variable driving voltage ELVSS_var may be changed for each frame and may have a stepped waveform. The variable driving voltage ELVSS_var may be, for example, linearly changed over time.

The variable initialization voltage Vinit_var may be varied (or changed) according to a change of the variable driving voltage ELVSS_var. As described with reference to FIGS. 3 and 4, the variable initialization voltage Vinit_var may have a voltage level greater than the variable driving voltage ELVSS_var by the setting voltage Voffset.

When the variable initialization voltage Vinit_var has a constant value (e.g., Vinit_const), a voltage applied to the emission element EL may be changed according to a change of the variable driving voltage ELVSS_var. The display device 100 according to one example embodiment may maintain (or keep) a voltage difference between the variable driving voltage ELVSS_var and the variable initialization voltage Vinit_var constant using the initialization voltage generator 160.

Figure 6:
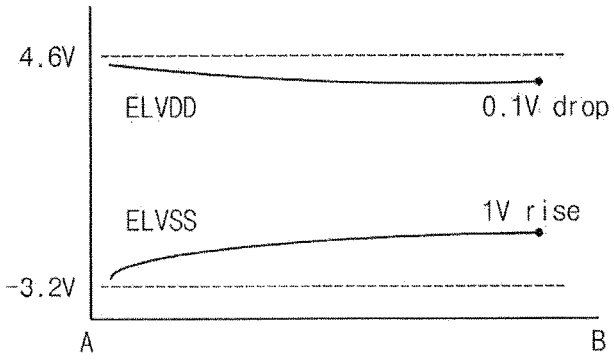
FIG. 6 illustrates an example of a driving voltage measured by a voltage sensor.

FIG. 6 is a waveform diagram illustrating an example of a driving voltage measured by a voltage sensor in the display device 100 of FIG. 1. Referring to FIGS. 1 and 6, a driving voltage (e.g., the first power voltage ELVDD or the second power voltage ELSS) supplied to the display panel 110 may change depending on a measuring point. For example, when the first power voltage ELVDD is supplied through a first point A, as the measuring point is moved from the first point A to a second point B, a first local driving voltage (e.g., the first power voltage ELVDD actually supplied to the pixel 111) of the first power voltage ELVDD may be reduced (or decreased). That is, as a distance between the first point A supplied to the first power voltage ELVDD and the measuring point is increased, a resistance drop (or IR drop) may be increased. Therefore, the first local driving voltage may be decreased based on (e.g., in proportion to) the increase in the resistance drop. For example, the first local driving voltage at the second point B may include a 0.1 volt (V) of the resistance drop. The resistance drop may be changed according to a driving current supplied to the display panel 110.

For example, when the second power voltage ELVSS is supplied through the first point A, as the measuring point is moved from the first point A to a second point B, a second local driving voltage (e.g., the second power voltage ELVSS actually supplied to the pixel 111) of the second power voltage ELVSS may be increased. The second local driving voltage may be increased according to increasing of the resistance drop. For example, the second local driving voltage may include 1 volt (V) of the resistance drop.

Figure 7A:
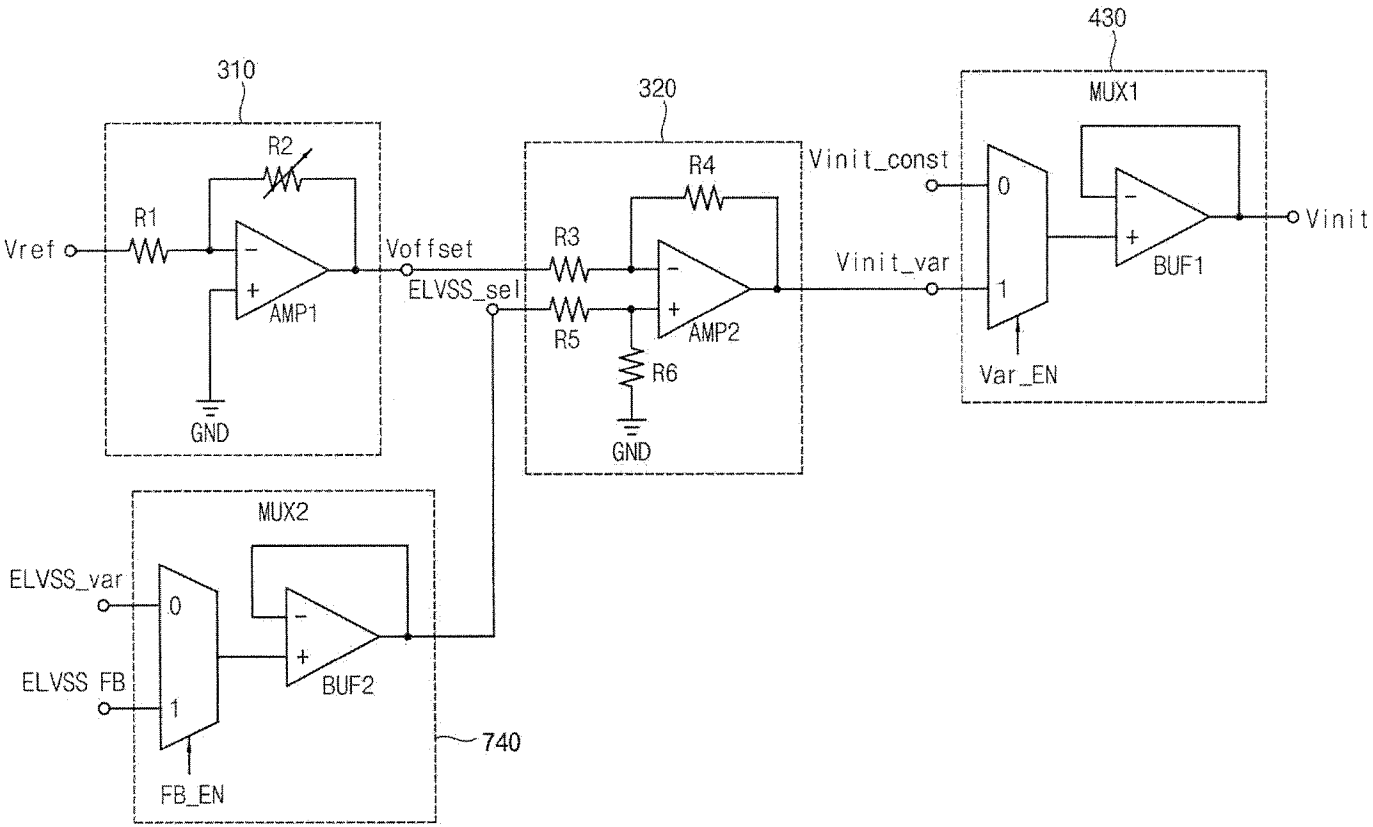
FIG. 7A illustrates an example of a circuit of the initialization voltage generator of FIG. 3.

FIG. 7A is a circuit diagram illustrating an embodiment of the initialization voltage generator 160 of FIG. 3. Referring to FIG. 7A, the initialization voltage generator 160 includes a voltage generator 310, a voltage adder 320, a first selector 430, and a second selector 740. The voltage generator 310, the voltage adder 320, and the first selector 430 in FIG. 7A may be the same as or similar to the voltage generator 310, the voltage adder 320 and the first selector 430 described with reference to FIGS. 3 and 4. The second selector 740 may provide one of a local driving voltage ELVSS_FB and the variable driving voltage ELVSS_var. The local driving voltage ELVSS_FB may be the second power voltage ELVSS of the display panel 110 measured through the voltage sensor 170. The local driving voltage ELVSS_FB may be changed according to a change of the measuring point as described with reference to FIG. 6.

As illustrated in FIG. 7A, the second selector 740 may include a second multiplexer MUX2 and a second buffer BUF2. The second multiplexer MUX2 may receive the local driving voltage ELVSS_FB and the variable driving voltage ELVSS_var and may output one of the local driving voltage ELVSS_FB and the variable driving voltage ELVSS_var in response to a measuring control signal FB_EN. The measuring control signal FB_EN may be provided from the timing controller 120. The second buffer BUF2 may be implemented as a buffer amplifier and may output a selected driving voltage ELVSS_sel having a voltage level that is the same as a voltage level of one of the local driving voltage ELVSS_FB and the variable driving voltage ELVSS_var.

The voltage adder 320 may add up (or sum) the selected driving voltage ELVSS_sel and the setting voltage Voffset. The voltage adder 320 may generate the variable initialization voltage Vinit_var to be greater than the selected driving voltage ELVSS_sel by the setting voltage Voffset.

The voltage sensor 170 may measure a plurality of local driving voltages of the variable driving voltage supplied to the display panel 110 and may sequentially output the plurality of the local driving voltages. For example, the voltage sensor 170 may measure a first local driving voltage of the second power voltage ELVSS at a first point A, a second local driving voltage of the second power voltage ELVSS at a second point B, and a third local driving voltage of the second power voltage ELVSS at a third point C (e.g., a center point between the first point A and the second point B). The voltage sensor 170 may provide the second selector 740 with the first local driving voltage, the second local driving voltage, and the third driving voltage.

The initialization voltage generator 160 may sequentially generate a plurality of initialization voltages according to the local driving voltages. For example, the second selector 740 may receive the first local driving voltage, the second local driving voltage, and the third driving voltage and may output one of the first local driving voltage, the second local driving voltage, or the third driving voltage in response to the measuring control signal FB_EN.

For example, the second selector 740 may select and output the first local driving voltage at a first time (or a first time point). The initialization voltage generator 160 may generate a first variable initialization voltage greater than the first local driving voltage by the setting voltage Voffset. The first variable initialization voltage may be used to initialize a first pixel row (e.g., pixels 111 in the first pixel row) including the first point A.

For example, the second selector 740 may select and output the second local driving voltage at a second time (or a second time point). The initialization voltage generator 160 may generate a second variable initialization voltage to be greater than the second local driving voltage by the setting voltage Voffset. The second variable initialization voltage may be used to initialize a second pixel row (e.g., pixels 111 in the second pixel row) including the second point B.

Thus, the initialization voltage generator 160 may maintain (or keep) a voltage difference between the variable driving voltage ELVSS_var (or the local driving voltage ELVSS_FB) and the variable initialization voltage Vinit_var to be constant (e.g., the voltage difference=the setting voltage Voffset).

Figure 7B:
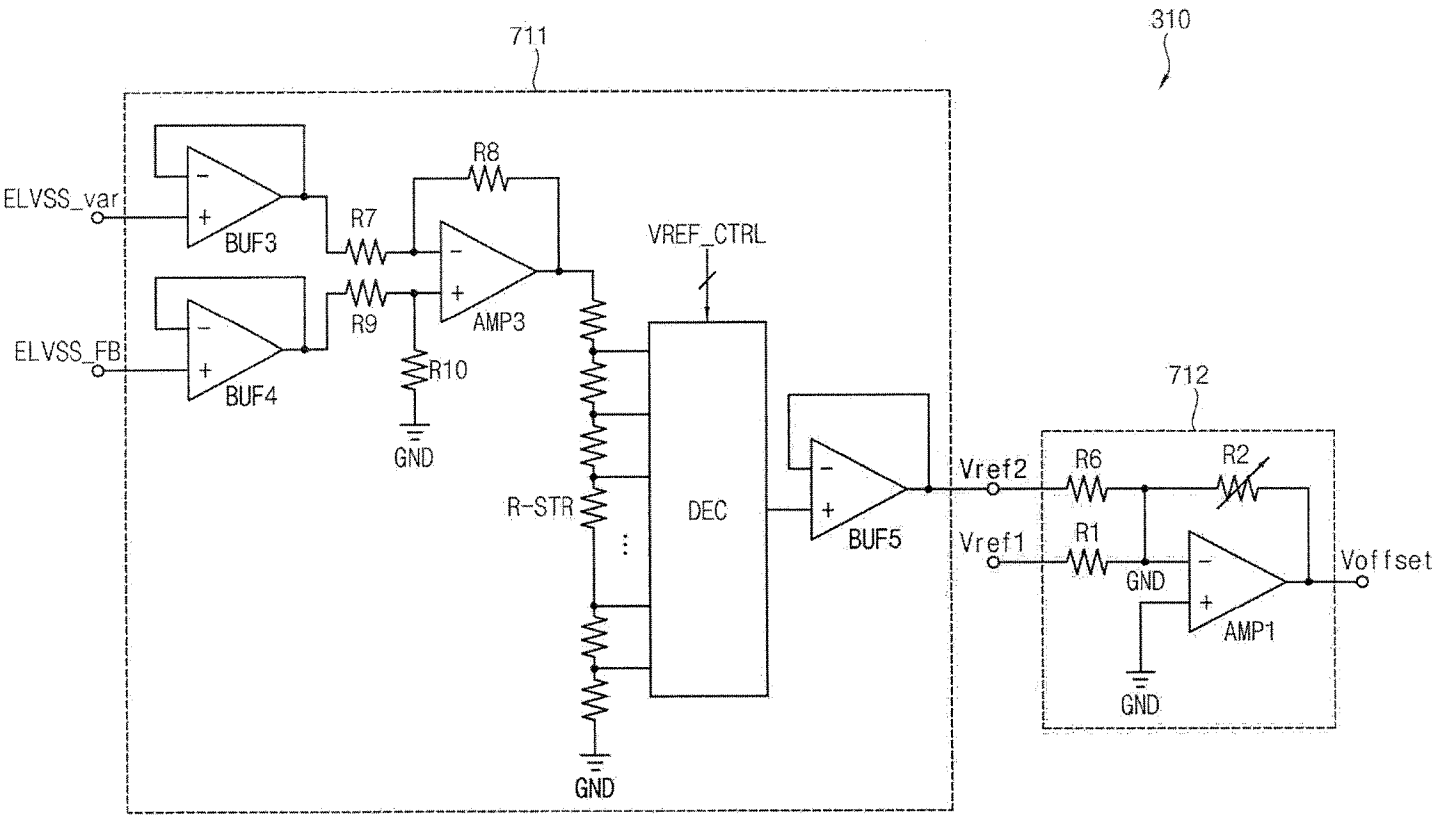
FIG. 7B illustrates an example of a voltage generator in the initialization voltage generator of FIG. 3.

FIG. 7B is a circuit diagram illustrating an embodiment of a voltage generator in the voltage generator 310 of FIG. 3. The voltage generator 310 of FIG. 3 may generate the setting voltage Voffset based on the variable driving voltage ELVSS_var, the local driving voltage ELVSS_FB, and a first reference voltage Vref1 (e.g., the reference voltage in FIG. 4). The local driving voltage ELVSS_FB may be the second power voltage ELVSS of the display panel 110 measured by the voltage sensor 170 described with reference to FIG. 1. Compared to the voltage generator 310 in the initialization voltage generator 160 of FIG. 4, voltage generator 310 of FIG. 7B may change the setting voltage Voffset based on the variable driving voltage ELVSS_var and the local driving voltage ELVSS_FB.

Referring to FIG. 7B, the voltage generator 310 may include a subtractor 711 and adder 712. The subtractor 711 may generate a second reference voltage Vref2 based on the variable driving voltage ELVSS_var and the local driving voltage ELVSS_FB. As described in FIG. 7B, the subtractor 711 may include a third buffer BUF3, a fourth buffer BUF4, and a third buffer BUF3. The third buffer BUF3 may be implemented, for example, as a buffer amplifier and may transfer the variable driving voltage ELVSS_var to the third amplifier AMP3. The fourth buffer BUF4 may be implemented as a buffer amplifier and may transfer the local driving voltage ELVSS_FB to the third amplifier AMP3. The third amplifier AMP3 may include a first input terminal that receives the variable driving voltage ELVSS_var through a seventh resistor R7, a second input terminal that receives a distributed local driving voltage ELVSS_FB, and an output terminal that outputs a voltage difference between the variable driving voltage ELVSS_var and the local driving voltage ELVSS_FB.

The distributed local driving voltage ELVSS_FB may be proportional to the local driving voltage ELVSS_FB and may be changed according to a resistance of a ninth resistor R9 and a resistance of the tenth resistor R10. A eighth resistor R8 may be electrically connected between the first input terminal of the third amplifier AMP3 and the output terminal of the third amplifier AMP3. A resistance of the eighth resistor R8 may be the same as the resistance of the seventh resistor R7. A resistance of the ninth resistor R9 may be the same as a resistance of the tenth resistor R10.

In some example embodiments, the voltage generator 310 may output the second reference voltage Vref2 based on Equation 3.

$$\begin{aligned} Vref2 &= \text{LVSS_var} - \frac{R7+R8}{R7} * \\ &\quad E\left(\text{ELVSS_var} - \frac{R9}{R9+R10} * \text{ELVSS_FB}\right) \\ &= \text{ELVSS_FB} - \text{ELVSS_var} \\ &\quad (\text{where, } R7 = R8,\ R9 = R10) \end{aligned} \tag{3}$$

That is, the second reference voltage Vref2 may be a voltage difference between the local driving voltage ELVSS_FB and the variable driving voltage ELVSS_var.

In some example embodiments, the subtractor 711 may change the second reference voltage Vref2. As illustrated in FIG. 7B, the subtractor 711 may include a resistor string R-STR (or resistor array), a decoder DEC, and a fifth buffer BUF5. The resistor string R-STR may include resistors, may distribute the voltage difference (e.g., the voltage difference between the variable driving voltage ELVSS_var and the local driving voltage ELVSS_FB) using the resistors, and may output voltages (e.g., distributed voltages). The decoder DEC may receive the voltages (e.g., the distributed voltages) from the resistor string R-STR, select one among the distributed voltages based on a reference voltage control signal VREF_CTRL, and may output one selected among the distributed voltages as the second reference voltage Vref2. The reference voltage control signal VREF_CTRL may be provided from the timing controller 120. The fifth buffer BUF5 may be implemented as a buffer amplifier and may transfer an output of the decoder DEC to the adder 712.

In some example embodiments, the subtractor 711 may out the second reference voltage Vref2 that is changed in time. As illustrated in FIG. 6, the driving voltage supplied to the display panel 110 may be changed according to a measuring point. The display device 100 may measure the second driving voltage ELVSS at a second point B, generate the second reference voltage Vref2 based on a measured second driving voltage (e.g., the local driving voltage ELVSS_FB) at the second point B, and change the second reference voltage Vref2 using the decoder DEC corresponding to a change of the second local driving voltage in FIG. 6.

For example, the subtractor 711 may output the second reference voltage Vref2 having 0 volts (e.g., a voltage corresponding to a resistance drop of the second driving voltage ELVSS at the first point A) at a first time (or a first time point), e.g., a time at which a scan signal is provide to the first point A. The subtractor 711 may, for example, output the second reference voltage Vref2 having 0.7 volts (e.g., a voltage corresponding to a resistance drop of the second driving voltage ELVSS at a center point between the first point A and the second point B) at a second time (or a second time point) (e.g., a time at which a scan signal is provide to the center point). For example, the subtractor 711 may output the second reference voltage Vref2 having 1 volt (e.g., a voltage corresponding to a resistance drop of the second driving voltage ELVSS at the second point B) at a third time (or a third time point), e.g., a time at which a scan signal is provide to the second point B.

The adder 712 may generate the setting voltage Voffset by adding up (or summing) the first reference voltage Vref1 and the second reference voltage Vref2. The adder 712 illustrated in FIG. 7B may be the same as or similar to the voltage generator 310 in FIG. 4. The adder 712 may include a configuration to amplify the second reference voltage Vref2. For example, the adder 712 may include a sixth resistor R6 electrically connected between an output terminal of the subtractor 711 and the first input terminal of the first amplifier AMP1 that amplifies the second reference voltage Vref2 transferred through the sixth resistor R6.

In some example embodiments, the setting voltage may be represented by Equation 4.

$$V\text{offset} = -(R2/R1)*(V\text{ref1} + V\text{ref2}) \tag{4}$$

The variable initialization voltage Vinit_var may be represented by Equation 5.

$$\begin{aligned} \text{Vinit_var} &= (0.5 * \text{ELVSS_var}) + [(0.5 * \text{ELVSS_var}) - Voffset] \\ &= \text{ELVSS_var} + Voffset[DC] + Voffset[var] \\ &\quad (\text{where, } Voffset[dc] = -R2/R1 * Vref1, \\ &\quad Voffset[var] = \text{ELVSS_FB} - \text{ELVSS_var}) \end{aligned} \tag{5}$$

Voffset[dc] denotes a fix component of the setting voltage Voffset corresponding to the first reference voltage Vref1, and Voffset[var] denotes a variable component of the setting voltage Voffset based on the variable driving voltage ELVSS_var and the local driving voltage ELVSS_FB.

As described above, the voltage generator 310 may generate the second reference voltage Vref2 based on the variable driving voltage ELVSS_var and the local driving voltage ELVSS_FB, and may set the voltage Voffset based on the second reference voltage Vref2. Therefore, the initialization voltage generator 160 may maintain (or keep) a voltage difference between the variable driving voltage ELSS_var (or the local driving voltage ELVSS_FB) and the variable initialization voltage Vinit_var to be constant even if a resistance drop of the driving voltage occurs. In addition, the voltage generator 310 may change the second reference voltage Vref2 using the decoder DEC. Therefore, the voltage generator 310 may maintain (or keep) a voltage difference between the variable driving voltage ELSS_var and the variable initialization voltage Vinit_var for each point of the display panel 110 using only the local driving voltage ELVSS_FB measured at one point (e.g., the second point B) of the display panel 110.

Figure 8A:
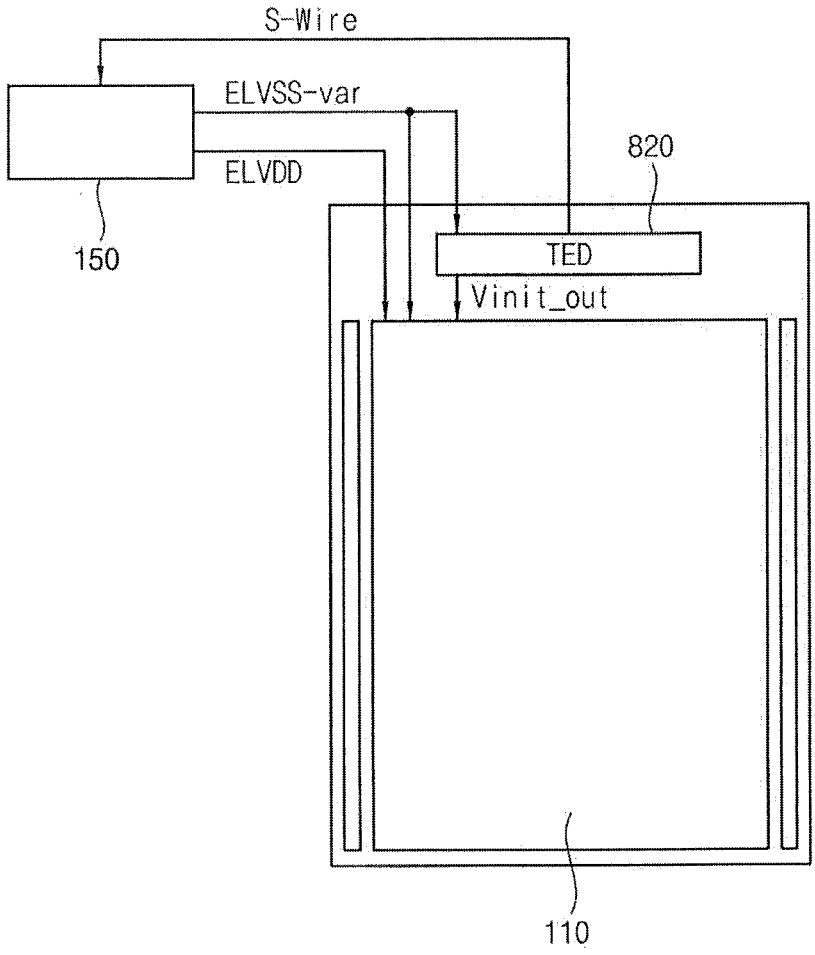
FIG. 8A illustrates an embodiment of a display device.

FIG. 8A illustrates an embodiment of the display device 100 of FIG. 1. In FIG. 8A, the display device 100 may include a display panel 100, a power supplier 150, and an integrated circuit 820. The integrated circuit 820 may include the timing controller 120, the data driver 130, the scan driver 140, and the initialization voltage generator 160 in FIG. 1. For example, the integrated circuit 820 may be implemented as one integrated circuit (IC) and may include the initialization voltage generator 160. The integrated circuit 820 may be on the display panel 110 (or a display module), e.g., the integrated circuit 820 may be in the display panel 110.

Figure 8B:
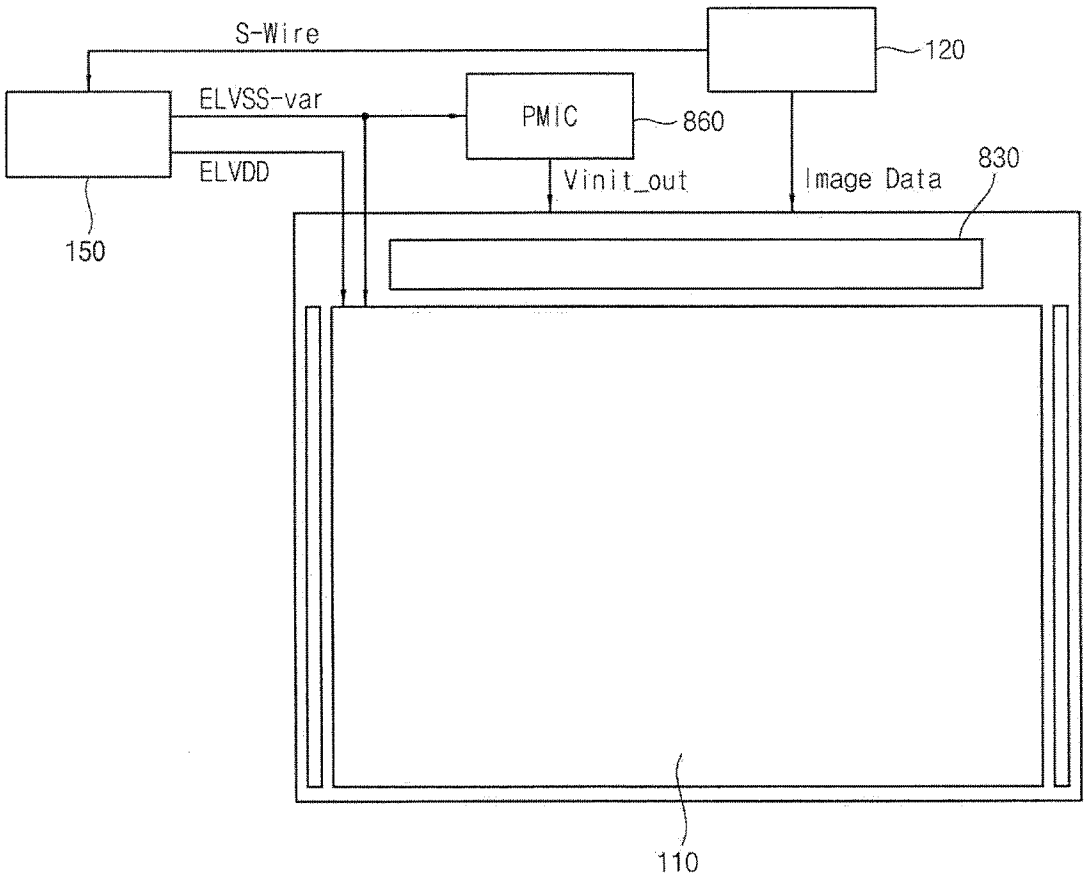
FIG. 8B illustrates a another embodiment of a display device.

FIG. 8B illustrates another embodiment of the display device 100 of FIG. 1. In FIG. 8B, the display device 100 may include a display panel 110, a timing controller 120, a power supplier 150, an integrated circuit 830, and an initialization voltage generator 860. The integrated circuit 830 may include the data driver 130 and the scan driver 140 in FIG. 1. The initialization voltage generator 860 may be separated from the timing controller 120 and the power supplier 150. The initialization voltage generator 860 may be located in or outside of the display panel 110 (or a display module).

As described above, the initialization voltage generator 860 may be implemented with the timing controller 120, the power supplier 150, etc, or may be separated from the timing controller 120, the power supplier 150, etc.

Figure 9:
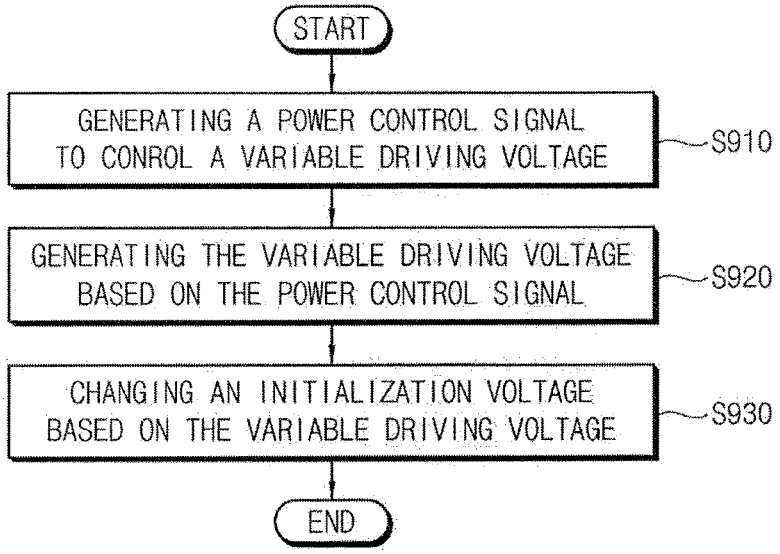
FIG. 9 illustrates an embodiment of a method for driving a display device.

FIG. 9 illustrates an embodiment of a method for driving a display device, which, for example, may be any of the aforementioned embodiments of the display device. Referring to FIGS. 1 and 9, the method of driving a display device may drive the display device 100. The method of FIG. 9 may include generating a power control signal to control a variable driving voltage of the display panel 110 based on an input image (S910). For example, the method of FIG. 9 may include calculating an on-pixel ratio of the input image and generating the power control signal to change the second power voltage ELVSS based on the on-pixel ratio.

The method may include generating the variable driving voltage based on the power control signal (S920). For example, the method of FIG. 9 may include generating the second power voltage ELVSS based on the power control signal. The second power voltage ELVSS may be changed in response to the power control signal.

The method may include changing an initialization voltage according to the variable driving voltage, where, the initialization voltage may initialize the pixels 111 (S930). Referring to FIG. 4, the method may include generating the setting voltage Voffset based on a reference voltage (or a first reference voltage) (e.g., Vref) and generating the variable initialization voltage Vinit_var based on the variable driving voltage ELVSS_var and the setting voltage Voffset.

The method may also include outputting one of a pre-generated reference initialization voltage Vinit_const or the variable initialization voltage Vinit_var, as the initialization voltage Vinit. The reference initialization voltage Vinit_const may have a constant predetermined voltage level.

The method may change the initialization voltage Vinit according to a change of the variable driving voltage and may maintain (or keep) a voltage difference between the variable driving voltage and the initialization voltage Vinit. Therefore, the method may maintain a discharging characteristic of the pixel 111 (e.g., a parasitic capacitor of an organic light emitting diode) and may prevent an afterimage due to a change of a discharging characteristic of the pixel 111.

Figure 10:
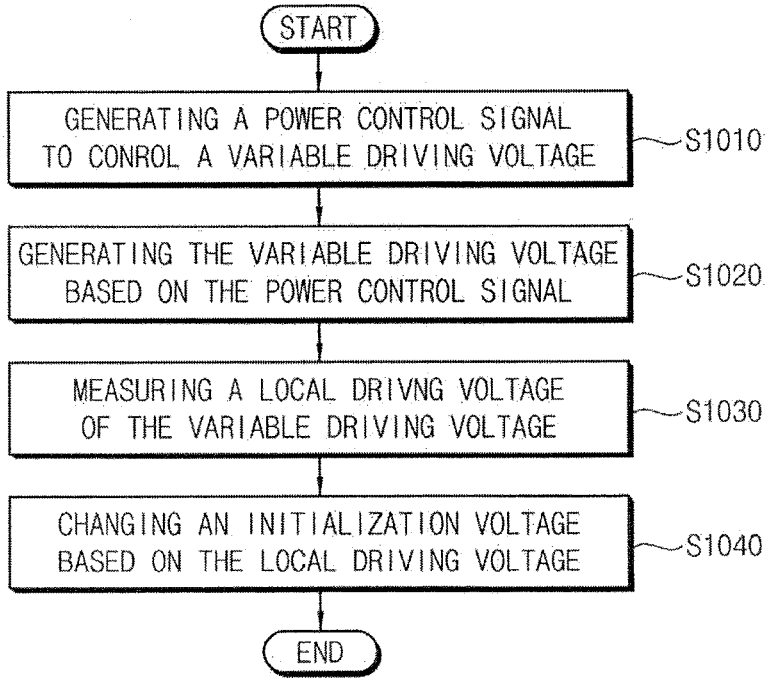
FIG. 10 illustrates another embodiment of a method for driving a display device.

FIG. 10 illustrates another embodiment of a method for driving a display device, which, for example, may be any of the aforementioned embodiments of the display device. The method may include generating a power control signal to control a variable driving voltage of the display panel 110 based on the input image (S1010). A configuration of generating the power control signal may be the same as or similar to a configuration of generating the power control signal in FIG. 9.

The method may include generating the variable driving voltage based on the power control signal (S1020). A configuration of generating the variable driving voltage may be the same as or similar to a configuration of generating the variable driving voltage in FIG. 9.

The method may include measuring a local driving voltage supplied to the display panel 110 according to the variable driving voltage (S1030). In some example embodiments, the method of FIG. 10 may include measuring a plurality of local driving voltages of the variable driving voltage supplied to the display panel 110 using the voltage sensor 170 and may include sequentially outputting the plurality of the local driving voltages.

The method may include changing the initialization voltage according to the local driving voltage (S1040). Referring to FIG. 7A, the method may include generating the setting voltage Voffset based on a reference voltage (e.g., Vref) and generating the variable initialization voltage Vinit_var based on the local driving voltage ELVSS_FB and the setting voltage Voffset.

The method may further include outputting one, selected from a reference initialization voltage Vinit_const that is pre-generated and the variable initialization voltage Vinit_var, as the initialization voltage Vinit.

The method may further include selecting one from the local driving voltage ELVSS_FB and the variable driving voltage ELVSS_var. Here, the method may generate the initialization voltage Vinit based on a selected driving voltage (e.g., the local driving voltage ELVSS_FB or the variable driving voltage ELVSS_var).

As described above, the method of FIG. 10 may generate the initialization voltage based on the local driving voltage. Therefore, the method of FIG. 10 may maintain (or keep) a voltage difference between the variable driving voltage and the initialization voltage Vinit.

The embodiments described herein may be applied to any display device (e.g., an organic light emitting display device, a liquid crystal display device, etc). For example, the present inventive concept may be applied to a television, a computer monitor, a laptop, a digital camera, a cellular phone, a smart phone, a personal digital assistant (PDA), a portable multimedia player (PMP), an MP3 player, a navigation system, a video phone, etc.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controllers, adders, subtractors, and other processing features of the embodiments described herein may be implemented in logic which, for example, may include hardware, software, or both. When implemented at least partially in hardware, the controllers, adders, subtractors, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, adders, subtractors, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a display panel including pixels;

a controller to generate a power control signal based on an input image;

a power supplier to generate a variable driving voltage that is changed based on the power control signal; and an initialization voltage generator to generate an initialization voltage to initialize the pixels, and to change the initialization voltage in response to a change of the variable driving voltage such that the initialization voltage and the variable driving voltage have a substantially constant voltage difference for an entire period of one or more frames.

2. The display device as claimed in claim 1, wherein the initialization voltage generator includes:

a voltage generator to output a setting voltage based on a first reference voltage; and a voltage adder to generate the initialization voltage based on the variable driving voltage and the setting voltage.

3. The display device as claimed in claim 2, wherein the voltage generator includes:

a first resistor;

a first amplifier including a first input terminal to receive the first reference voltage through the first resistor, a second input terminal electrically connected to a reference voltage, and an output terminal to output the setting voltage; and a second resistor electrically connected between the first input terminal and the output terminal.

4. The display device as claimed in claim 2, wherein the voltage adder includes:

a third resistor;

a second amplifier including a first input terminal to receive the setting voltage through the third resistor, a second input terminal to receive the variable driving voltage, and an output terminal to output the initialization voltage; and a fourth resistor electrically connected between the first input terminal and the output terminal.

5. The display device as claimed in claim 2, wherein the initialization voltage generator includes a first selector to output one of a reference initialization voltage or the initialization voltage.

6. The display device as claimed in claim 2, further comprising:

a voltage sensor to measure a local driving voltage of the display panel, wherein the initialization voltage generator includes a second selector to provide the voltage adder with one of the local driving voltage or the variable driving voltage.

7. The display device as claimed in claim 6, wherein the second selector includes:

a multiplexer to select one of the local driving voltage and the variable driving voltage; and a buffer amplifier to transfer an output of the multiplexer to the voltage adder.

8. The display device as claimed in claim 7, wherein the voltage sensor is to measure a plurality of local driving voltages at a plurality of measuring points of the display panel, respectively, and to sequentially output the local voltages.

9. The display device as claimed in claim 8, wherein the initialization voltage generator is to sequentially generate a plurality of initialization voltages based on the local driving voltages.

10. The display device as claimed in claim 2, further comprising:

a voltage sensor to measure a local driving voltage of the display panel, wherein the voltage generator is to generate the setting voltage based on the local driving voltage, the variable driving voltage, and the first reference voltage.

11. The display device as claimed in claim 10, wherein the voltage generator includes:

a subtractor to calculate a voltage difference between the variable driving voltage and the local driving voltage and to generate a second reference voltage based on the voltage difference; and an adder to generate the setting voltage by adding the first reference voltage and the second reference voltage.

12. A display device, comprising:

a display panel including pixels;

a controller to generate a power control signal based on an input image;

a power supplier to generate a variable driving voltage that is changed based on the power control signal;

a voltage sensor to measure a local driving voltage provided to the display panel according to the variable driving voltage; and an initialization voltage generator to generate an initialization voltage to initialize the pixels, and to change the initialization voltage in response to a change of the variable driving voltage such that the initialization voltage and the variable driving voltage have a substantially constant voltage difference for an entire period of one or more frames.

13. The display device as claimed in claim 12, wherein the initialization voltage generator includes:

a voltage generator to output a setting voltage based on a first reference voltage;

a second selector to select one of the variable driving voltage or the local driving voltage;

a voltage adder to generate the initialization voltage based on the setting voltage and one of the variable driving voltage or the local driving voltage; and a first selector to output one of a reference initialization voltage or the initialization voltage.

14. The display device as claimed in claim 13, wherein the second selector includes:

a multiplexer to select one of the local driving voltage or the variable driving voltage; and a buffer amplifier to transfer an output of the multiplexer to the voltage adder.

15. The display device as claimed in claim 12, wherein the voltage sensor is to measure a plurality of local driving voltages at a plurality of measuring points, respectively, and sequentially output the local driving voltages.

16. The display device as claimed in claim 15, wherein the initialization voltage generator is to sequentially generate a plurality of initialization voltages based on the local driving voltages.

17. A method for driving a display device, the method comprising:

generating a power control signal to control a variable driving voltage of the display device based on an input image;

generating the variable driving voltage based on the power control signal; and changing an initialization voltage to initialize a plurality of pixels in response to a change of the variable driving voltage such that the initialization voltage and the variable driving voltage have a substantially constant voltage difference for an entire period of one or more frames.

18. The method as claimed in claim 17, wherein changing the initialization voltage includes:

measuring a local driving voltage provided to a display panel according to the variable driving voltage; and changing the initialization voltage based on the local driving voltage.

* * * * *